United States Patent [19]

Salomon

[11] 4,192,087

[45] Mar. 11, 1980

[54] SKI BOOT WITH FOOT-RETENTION DEVICE

[75] Inventor: Georges P. J. Salomon, Annecy, France

[73] Assignee: Etablissements Francois Salomon et Fils, Annecy, France

[21] Appl. No.: 879,997

[22] Filed: Feb. 22, 1978

[30] Foreign Application Priority Data

Feb. 23, 1977 [FR] France ..... 77 05264

[51] Int. Cl.[2] ..... A43B 5/04

[52] U.S. Cl. ..... 36/119

[58] Field of Search ..... 36/117, 118, 119, 120

[56] References Cited

U.S. PATENT DOCUMENTS

| | | | |
|---|---|---|---|
| 3,530,594 | 9/1970 | Vogel | 36/119 |
| 3,837,098 | 9/1974 | Rathmell | 36/119 |

FOREIGN PATENT DOCUMENTS

| | | | |
|---|---|---|---|
| 1963342 | 12/1969 | Fed. Rep. of Germany | 36/120 |
| 2709694 | 3/1977 | Fed. Rep. of Germany | 36/117 |

*Primary Examiner*—Patrick D. Lawson

*Attorney, Agent, or Firm*—Pollock, Vande Sande & Priddy

[57] ABSTRACT

A boot, particularly a ski boot, is provided with device for retaining the foot against both lateral and vertical movement. The device comprises a generally V-shaped support element having two deformable side plates which can be adjusted for gripping movement toward and away from the foot. The plates have a shape generally corresponding to that of the top of the forefoot, and thus distribute the gripping stresses over the entire surface of the top of the foot, obviating painful pressure spots. The means for adjusting the position of the side plates is controlled from the exterior of the boot. A rapid tightening-untightening arrangement can also be incorporated into the boot according to the invention.

16 Claims, 9 Drawing Figures

SKI BOOT WITH FOOT-RETENTION DEVICE

SUMMARY OF THE INVENTION

The present invention relates to a boot, particularly a ski boot, comprising a rigid shell and an arrangement for retaining the foot nounted on the inside of the shell substantially in the area of the widest part of the foot.

BACKGROUND OF THE INVENTION

Boots having a shell and a foot retention arrangement at the inside of such shell are known, e.g., from U.S. Pat. No. 3,883,964, German Published Application No. 1,801,920 and French Pat. No. 1,587,642.

For example, the ski boots disclosed in French Pat. No. 1,587,642 are provided with one or more straps between the shell and the slipper at the level where the foot joins the ankle, for the purpose of assuring good retention of the foot in the boot. However, this retention is not sufficient, particularly in the upper region, for the purpose of advanced or competitive skiing.

To correct this defect, certain boots (see especially those of U.S. Pat. No. 3,883,964) are provided with a rigid plate located between the shell and an interior slipper precisely at the upper region, and applied against the upper part of the slipper by means of a screw accessible from the outside of the shell. Thus, the retention of the foot in the upper region is improved. However, such a rigid plate system presents certain problems, among them the following:

(1) The direction of forces applied to the rigid plate between the shell and the slipper is contrained in a vertical plane. The result is either poor lateral retention of the foot, or excess vertical pressure to assure the desirable lateral retention.

(2) The screws forcing the rigid plate against the upper portion of the foot are emplaced on the top portion of the boot at the level of the upper in an area of low resistance which must sustain the force of the foot transmitted by the plate, and which is subject to deformation.

(3) The applied stresses are transmitted to the rigid plate via the screws which abut against the plate regions in substantially pin-point manner. The considerable restraints which result create the danger that the plate will be deformed and that painful spots will be formed at the upper part of the foot, more particularly during forward flexion which involves a slight deformation of the rigid shell and momentary high pressure on the screws.

It is an object of the present invention to provide a boot, particularly a ski boot, comprising a foot retention system which permits both good vertical retention and good lateral retention in the upper portion of the foot, while avoiding excess vertical pressure on the foot. Such an arrangement must not transmit stress to the upper boot, so that deformation of this area of least resistance is avoided, and must distribue the pressure necessary for the good retention of the foot to all or part of the frontal area.

To achieve this result, the boot according to the invention comprises a shell and a foot-retention system mounted on the inside of the shell, in the front part of the boot. The latter system in turn comprises a support element, independent of the sole, having a general V-shape, and comprising two side plates extending laterally and upon the top part of the forefoot, corresponding to the shape of the latter at its widest portion, as well as an adjustable means for tightening the support element against the foot, comprising means for displacing the two side plates of the support element and pressing them against the foot while adapting them to the top part of the forefoot, the support element abutting against the rigid shell, preferably laterally.

Thus, the foot is tightened against the internal sole of the boot and is laterally retained by the support element acting in the manner of a gripping "V". The two plates of the support element act in the manner of a gripping "V" upon the top part of the foot while forcing it against the inner sole due to the vertical components of the oblique support forces provided by the said plates of the support element, and retaining it laterally due to the horizontal components of the said oblique support forces.

Since the two plates of the support element have an anatomical shape corresponding to that of the top portion of the foot, and since the two plates are adjustable transversely on the foot, the stresses applied by the support element to the foot are suitably distributed over the entire surface of the top of the forefoot.

Moreover, the arrangement of the foot retention system in the upper region of the forefoot, at least in the widest area essentially corresponding to the metatarsus, permits the avoidance of painful spots at the articulated points. Thus, the arrangement provides heightened comfort without diminishing the technical efficiency of the ski boot.

A further advantage of the foot retaining system according to the present invention resides in the fact that the two plates of the support element act as a gripping "V", thereby performing a simultaneous foot centering function in the shell along its longitudinal axis. This advantage can be utilized for adapting to an ordinary shoe a foot having an abnormal orientation, whether inwardly or outwardly.

Finally, the two plates of the support element are controlled from the exterior of the boot by an adjustable gripping means which permits adjustment of the pressure brought to bear in accordance with the morphology of the skier's foot and the needs of the skier.

Various embodiments of the present invention are possible.

Fore example, according to a first modification, the means for moving the two side plates of the support element can comprise means for simultaneously moving, in opposite directions, the two side plates in a direction transverse with respect to the longitudinal axis of the foot. In this case, the two plates are mounted for transverse movement with respect to the shell, and are independent.

The means for simultaneously moving the two side plates of the support element transversely in opposite directions consist of (a) a threaded hole, respectively, in each of the two lateral plates of the support element;

(b) a screw transversely mounted on the rigid shell, movably rotatable about its axis and comprising two parts with reverse threading, each screwed into the two threaded holes; and (c) a control member accessible from the exterior of the rigid shell for turning the screw, the control member preferably also functioning as a stop for the screw.

The means for tranversely moving the two side plates of the support element in opposite directions can also comprise (d) two pressure elements movably mounted transversely with respect to the rigid shell and respectively abutting an inclined ramp integral with the lateral plate corresponding to the support member; and (e) means for actuating the two pressure elements from the exterior for transverse translation movement in opposite directions.

According to a second embodiment, the means for transversely moving the two lateral plates of the support element can also comprise means for moving each lateral plate of the support element in a direction substantially orthogonal to the lateral surface corresponding to the upper part of the foot.

The means for moving each lateral plate of the support element, in a direction substantially orthogonal to the corresponding lateral surface of the upper part of the foot, comprise, in the second embodiment, (a) two pressure elements movably mounted transversely with respect to the rigid shell and respectively abutting an inclined ramp integral with the lateral plate corresponding to the support member; and (b) means for actuating the two pressure elements from the exterior for transverse translation movement in opposite directions.

The two plates of the support element are preferably connected in a flexible manner with respect to a transverse direction, in such a way as to allow the support element to adapt its shape as closely as possible to the anatomy of the foot.

In both the first and second embodiments, the means for actuating the two pressure elements from the exterior may conveniently comprise (a) two threaded holes each respectively integral with each of the two pressure elements;

(b) a screw mounted on the rigid shell, movably rotatable about its axis and comprising two parts with reverse threading, each screwed into the corresponding threaded holes; and (c) an adjustment member accessible from the exterior of the rigid shell for turning the screw, the adjustment member preferably also functioning as a stop for the screw.

In respect to the embodiments just described, the tightening means comprises a screw or worm, but a cable system is also possible.

For example, it is possible to provide a system of crossed cable stretchers attached to the two portions of the support element. These slide on an axis transverse to the longitudinal axis of the foot through the action of cables which bring them into contact with the foot, in order to grip and retain the latter in the shell.

It is also possible to combine the foot retention system according to the invention with flexible means which automatically separate the two parts of the support element, in order to facilitate loosening of the device.

To all these different embodiments, one can add an arrangement for rapid loosening/tightening which makes it possible to discontinue instantly all gripping of the forefoot while yet retaining its original adjustment.

BRIEF INTRODUCTION TO THE DRAWINGS

A number of embodiments of boots according to the invention will now be described with reference to the accompanying drawings, in which FIG. 1 is a perspective view of a first embodiment;

DESCRIPTION OF PREFERRED EMBODIMENT

Figure 1:
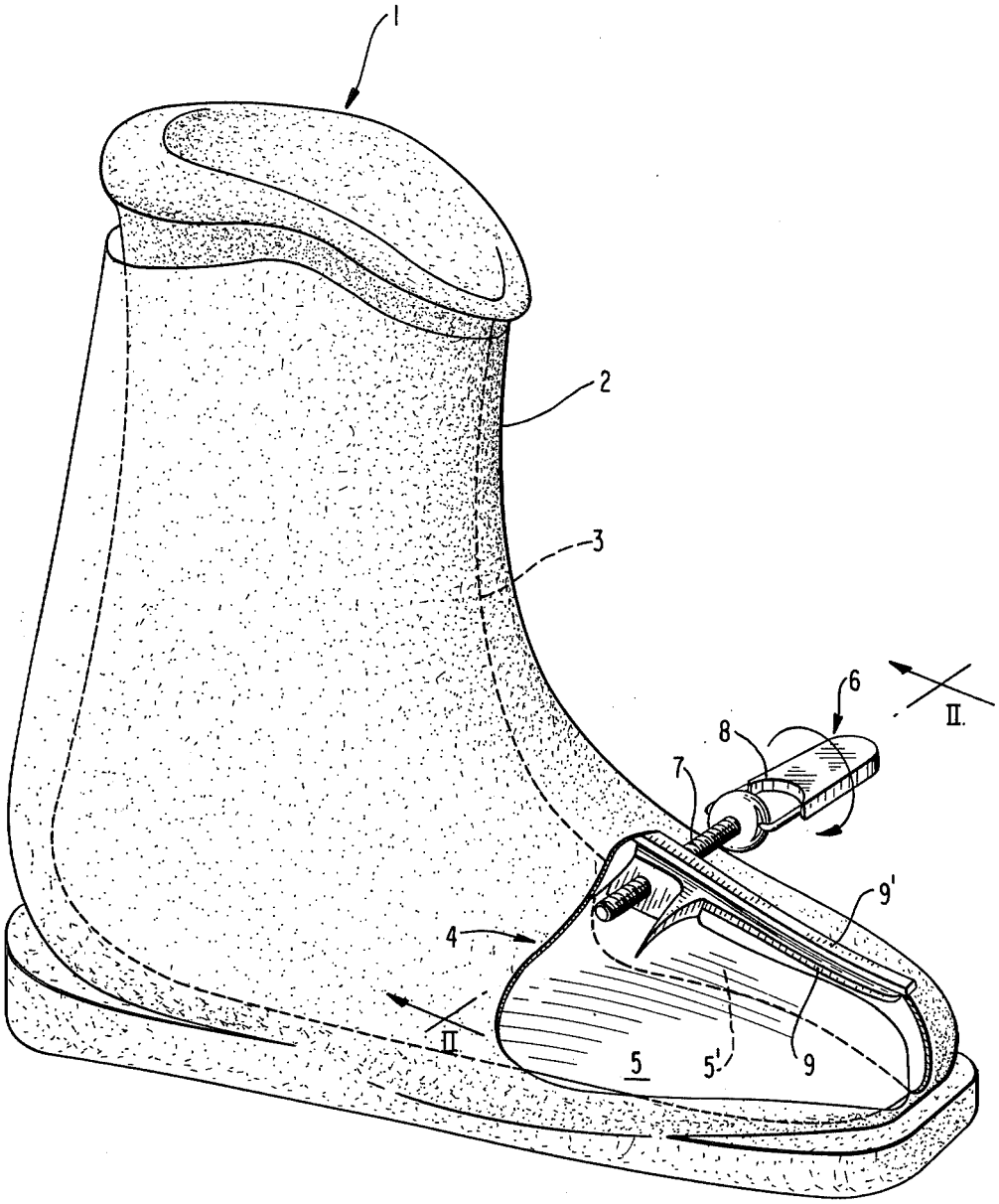

As shown in FIG. 1, a ski boot 1 is provided with a foot retention means 4 according to the invention. It includes a shell 2 which may have several parts and is provided with a means for opening (not shown) and a slipper 3 inside the shell. The foot retention means 4 is disposed between shell 2 and slipper 3 in the area of the forefoot. The support system for the foot retention means comprises two parts 5, 5', in the form of plates of elastically deformable material and shaped to conform to the anatomy of the top part of the forefoot; a gripping means 6 comprising a threaded rod 7, and a control member 8 which is actuatable from the exterior of the shell. Plates 5, 5' are preferably provided at their upper portions with a compensating strip 9 or 9' which retains the end of each of plates 5, 5', attached to the end of the foot. This compensating strip 9 or 9' is, by the nature of its profile, more rigid than plate 5. In fact, it is sufficiently separated from the upper part of this plate to act as a single leaf spring, to the point of abutting against the internal wall of shell 2.

Figure 2:
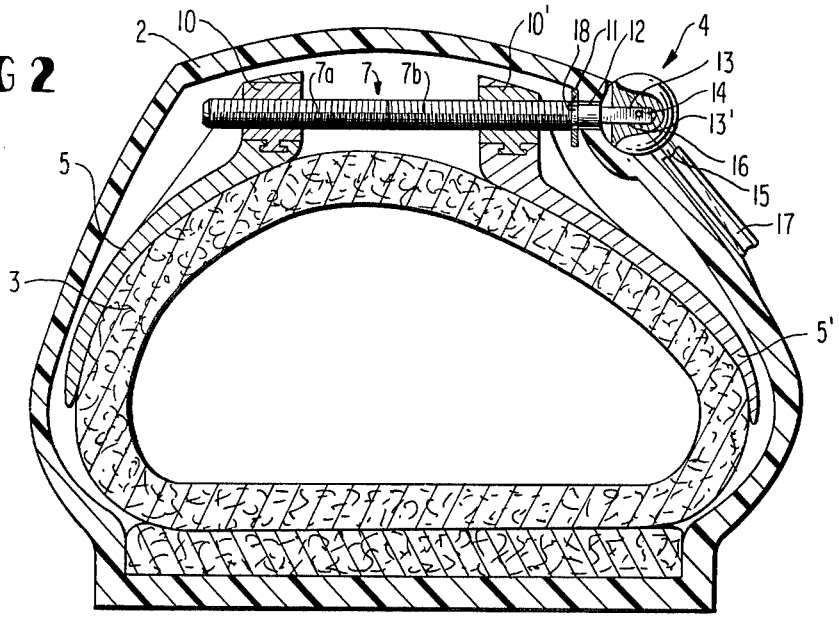
FIG. 2 is a section of FIG. 1 along line II—II, showing a detail of the first embodiment.
Figure 3:
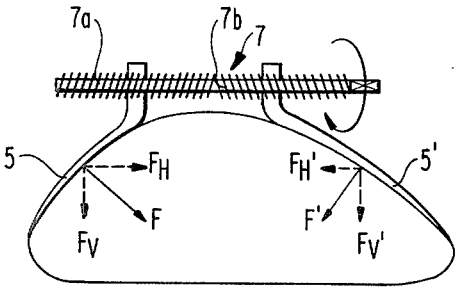
FIG. 3 is a schematic view of the embodiment according to FIG. 1, showing the oblique support forces of the support member on the foot.

FIGS. 2 and 3 show in detail the functioning principle of the foot retention system. Arranged between shell 2 and slipper 3, foot retention device 4 is integrated with the shell by one of the ends of threaded rod 7 which passes through an opening 12 provided for this purpose in shell 2. An annular member 11 resting against a shoulder 18 of threading 7*b* on the inner side of the shell prevents rod 7 from leaving the latter, except for end portion 13 provided, for example, with square driving block 13*a* fitted into a spherical member 16 acting as a swivel joint, in the instant embodiment. This swivel joint 16 thus prevents rod 7 from being displaced toward the interior of the shell. Ready manipulation of the control means is facilitated by a tongue 17 whose brace 15 acts as pivot axis 14 and as a cotter with respect to the spherical member and the end portion 13 of the rod. It will be seen that the threaded rod is thus connected to the shell, and thence to the entire foot retention system. In effect, the two parts 5, 5' of the support element are each screwed to one of the halves 7*a*, 7*b*' of the threaded rod in opposite directions of travel.

The screwing of plates 5, 5' is made possible by the insertion of screw nuts 10, 10' in the upper part of said plates. Clearly, these nuts have threading corresponding to the part of the rod on which they are to be screwed. It will be noted that, in the illustrated embodiment under discussion, only one of the ends 13 of the rod is set, with sufficient play, in the shell, causing a certain overhang of the entire foot retention system in the shell, and thus difficulty in putting on the boot. This, however, does not present a problem, because in fact the said foot retention system rests, via the interposed plates of the support element, ont the outer surface of boot 3 which has, despite its pliancy, a certain consistency. It results that the foot retaining system cannot collapse into the shell space, and smooth introduction of the foot into the boot is therefore always feasible. Obviously, it is also possible to provide for setting both ends of the rod in the shell, without departing from the invention.

Depending on whether the control means is rotated in one direction or the other, screw nuts 10, 10' and thence plates 5, 5' of the support element are displaced on threaded portions *7a* and *7b*. In the case in which they move toward one another, they exercise a force F against the foot contained in the slipper. Because of the anatomical shape of the support elements, this force is obliquely directed upon the foot. Its vertical and horizontal components thus assure both vertical and lateral retention of the foot, without there being excess pressure in either of these directions. Moreover, the pliancy of the plates forming the support element facilitates further adaptation to the different morphologie of the individual foot.

FIG. 3 shows schematically, perpendicular to the longitudinal axis of the foot, the make-up of the oblique support forces F and F', i.e., horizontal forces $F_H$ and $F'_H$ for lateral retention, and vertical forces $F_V$ and $F'_V$ for vertical retention, for each of support plates 5, 5' being displaced toward one another during gripping of the forefoot.

Figure 4:
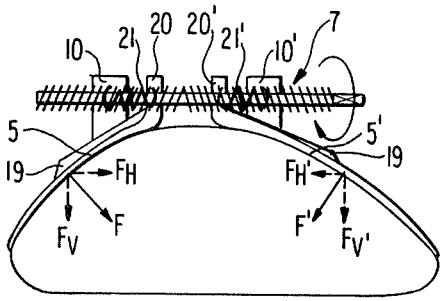
FIGS. 4 and 5 are schematic views of a second embodiment in which the pressure screws are not integral with the support element.
Figure 5:
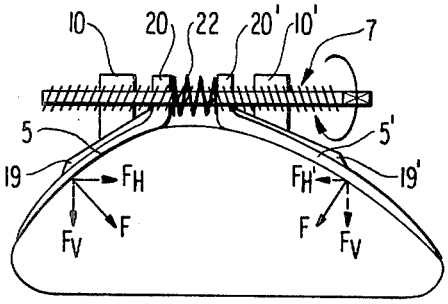

FIGS. 4 and 5 illustrate schematically modifications of the foot retention means. In these two embodiments, the pressure nuts 10, 10' which allow the support plates to move in opposite directions are not directly integrated with the latter, but rather are on the exterior and act on guide ramps 19, 19' arranged on the upper part of plates 5, 5'. When threaded rod 7 is turned to effect gripping, nuts 10, 10' move toward one another and come into contact with ramps 19, 19'. The latter are thereby forced toward one another while sliding on the threaded rod, appropriate means 20, 20' being provided on the plates to facilitate this sliding movement. During untightening, the nuts move apart, carrying with them the plates which are loaded by elastic traction means 21, 21' (FIG. 4) or compression means 22 (FIG. 5).

Figure 6:
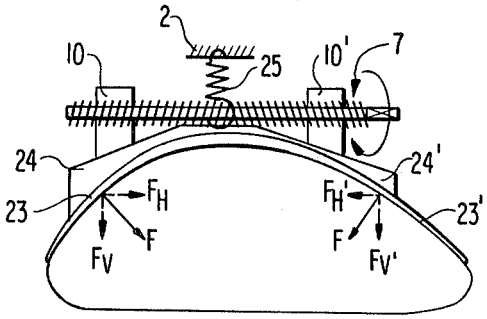
FIG. 6 is a schematic view of a third embodiment in which the pressure screws cause vertical movement of the support plates.

FIG. 6 schematically illustrates yet another means of achieving foot retention in accordance with the present invention. In this embodiment, support plates 23, 23' are interconnected and move in a vertical direction substancially orthogonal to the lateral surface corresponding to the top of the foot. Thus, while the pressure nuts 10, 10', independent of plates 23, 23', move transversely in opposite directions, they approach one another while forcing plates 23, 23' downwardly and bringing oblique support forces to bear on the foot via symmetrical ramps 24, 24' which are arranged on the plates and with which the said nuts cooperate. On the other hand, while the pressure nuts 10, 10' separate during untightening, support plates 23, 23' move upwardly, thereby freeing the foot of all contact. The upward movement is caused by resilient means 25, of which one portion is attached to the shell and the other part to the support plates. This resilient means 25 maintains plates 23, 23' in permanent contact with the pressure nuts. Preferably, the latter are flexibly joined with respect to a transverse direction, so as to allow the support element to adapt itself to the maximum extent to the anatomy of the top of the forefoot. It is to be emphasized that the lateral, substancially symmetrical arrangement of the two pressure nuts promotes the adaptation of the support element to the obstacle respresented by the foot.

According to a modification of the last-mentioned embodiment, the resilient means can be replaced by an assembly element rigid with the shell. In this case, the pressure nuts, during their displacement, act on the support plates so as to deform them, causing a change in their angle of inclination, and thus, a displacement of the loci of application of the support forces.

Figure 7:
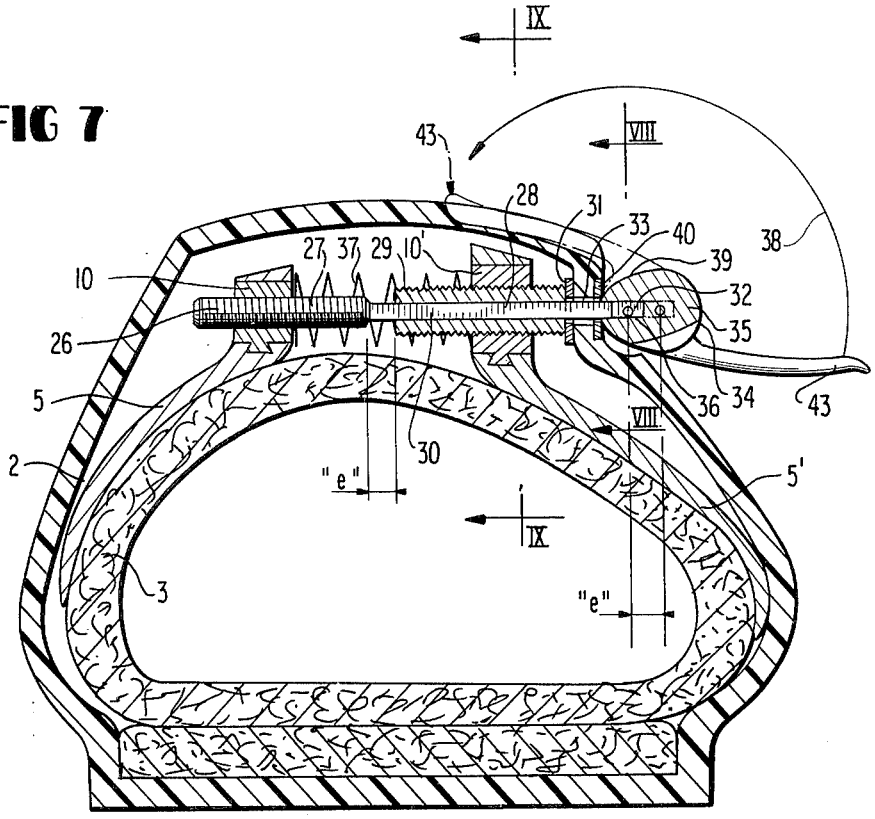
FIG. 7 is a sectional view showing a detail of a variant of the first embodiment, comprising means for rapid tightening and loosening.

FIG. 7 shows a foot retention system according to the invention comprising an arrangement for rapid tightening and loosening. The functioning of support plates 5, 5' with respect to the foot is indentical with that described with reference to FIG. 2. The following description is therefore confined to the arrangement for rapid tightening and loosening.

Rod 26 comprises threading 27 on a little less than half its length, the remaining portion 28 being shaped in accordance with a retaining block. Threaded portion 27 of rod 26, with a right-handed thread, is screwed into a nut 10 solid with support plate 5'. The remaining portion 28 receives a threaded sleeve 29 with left-handed thread, comprising a bore 30 of a section corresponding to the retaining block, with sufficient play to permit smooth sliding movement on this portion. This threaded sleeve 30, which has the same length as the threaded portion 27 of the rod, is screwed into a nut 10' solid with support plate 5'. An annular stop member 31 prevents sleeve 30 from contacting shell 2. The end 32 of portion 28 of the rod extends through a shell 2 by way of an orifice 33 provided for this purpose. A control member (a lever) provided with an eccentric 35 (the distance between the centers of which is "e" ) is attached to the end 32 of portion 28 on a pivot axis 36. Thus, the rod is prevented from movement toward the interior of the shell. Finally, the essential means for rapid tightening and loosening of resilient means 37, particularly a compression spring, are arranged between the two plates 5, 5' to force them to separate from the start of the loosening process. As illustrated in FIG. 7, where the system is in loosened position, spring 37 separate plates 5, 5' by a distance "e", the size of this separation being equal to the difference between the length of rod 26 within shell 2 and the sum of lengths of the threaded portions of portion 27 and sleeve 29. During tightening, control element 34 rotates in the direction of arrow 38 about axis 36; the periphery 39 of eccentric 35 slides on reinforced wall 40 of the shell while causing the translational movement of pivot axis 36, thence, that of rod 26. As a result, spring 37 is compressed between the two support plates 5, 5'. The threaded portion 27 and sleeve 29 are then end-to-end in a selected clamping position by means of the positions of the nuts chosen, for example, while the device is in loosened position.

Figure 9:
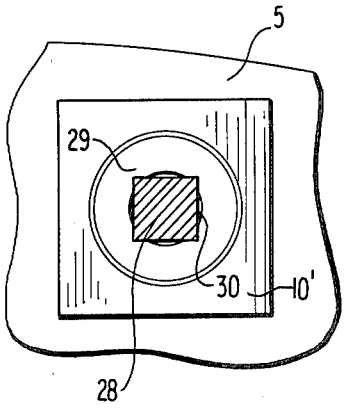
FIGS. 8 and 9 are sectional views showing details of the control member according to the embodiment shown in FIG. 7.
Figure 8:
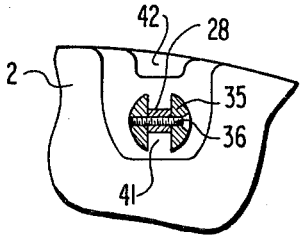

FIGS. 8 and 9, respectively, show a detail of the articulation of control member 34 upon portion 28, and a detail of the sliding assembly of sleeve 29 on the same portion 28. In FIG. 8, it can be seen that control means 34 having a roughly spherical volume comprises a groove 41 which permits clearance of end 32 of rod 26 during its rotation from one position to the other. Finally, a cavity 42 is provided in shell 2 for stowing the arm 43 of control means 34 in closed position (in dotted lines).

Tancks to this arrangement for rapid manual tightening and loosening, a skier waiting on a lift line can easily decompress his foot by simply rotating lever 34. Upon resumption of skiing, he regains the original gripping position by rotation of the lever in the opposite direction, without having to screw or unscrew anything. Rotation of the threaded rod constitutes a means for adjusting foot retention, and is unnecessary at the time of boot removal.

The invention is not limited to the foregoing embodiments, which have only been described by way of example. For example, the constituent elements may be disposed in different arrangements, and may be adapted to footwear other than ski boots.

What is claimed is:

1. A boot comprising (a) a rigid shell;

(b) a foot retention system mounted on the interior of the shell in the area of the forefoot, said foot retention system comprising (i) a support means, independent of the sole of the boot and having a generally V-shape, comprising two side plates extending laterally and upon the upper part of the forefoot, having a shape corresponding substantially to the anatomy of said forefoot at its widest point; and (ii) an adjustable means for clamping said support means against a foot within said boot, comprising means for simultaneously moving said two side plates and pressing them against said foot while adapting them to the anatomy of the upper part of the forefoot, said clamping means being supported on said shell in such manner that said foot is clamped against the inner sole of said boot and is laterally maintained by said support means.

2. A boot according to claim 1, wherein said means for simultaneously moving said two side plates of said support means comprise means for moving said side plates in opposite directions substantially transversely to the longitudinal axis of said foot, said two side plates being movably mounted substantially transversely on said shell and being independent.

3. A boot according to claim 2, wherein said means for simultaneously moving said two side plates of said support means comprises (a) two threaded holes respectively solid with each of said two side plates;

(b) a screw mounted transversely on said rigid shell, movable by rotation about its axis and comprising two portions threaded in opposite directions each screwed in one of said two holes; and (c) a control means accessible from the exterior of said rigid shell for turning said screw.

4. A boot according to claim 2, wherein said means for simultaneously moving said two side plates in opposite directions comprises two pressure elements movably mounted transversely of said rigid shell and each respectively abutting against an inclined ramp solid with the corresponding side plate, and means for actuating said pressure elements from the exterior for transverse translation movement in opposite directions.

5. A boot according to claim 1, wherein said means for simultaneously moving said two side plates comprises means for moving each said side plate in a directions substantially orthogonal to the lateral surface corresponding to the top of said foot.

6. A boot according to claim 5, wherein said means for moving each said side plate in a direction substantially orthogonal to the lateral surface corresponding to the top of said foot comprises two pressure elements movably mounted transversely of said rigid shell and each respectively abutting against an inclined ramp solid with the corresponding side plate, and means for actuating said pressure elements from the exterior for transverse translation movement in opposite directions, said two side plates being connected in a flexible manner.

7. A boot according to claim 4 or 6, wherein said means for actuating said pressure elements from the exterior comprises:

(a) two threaded holes respectively solid with each of said two pressure elements;

(b) a screw mounted on said rigid shell movable by rotation about its axis and comprising two portions threaded in opposite directions, each screwed in one of said two holes; and (c) a control means accessible from the exterior of said rigid shell for turning said screw.

8. A boot according to claim 1, wherein said clamping means further comprises resilient which actuate said support element in such manner as to separate said two side plates while unclamping them from the foot.

9. A boot according to claim 1, wherein said clamping means further comprises manual means for rapid tightening and loosening of said clamping means.

10. A boot according to claim 9 wherein said means for simultaneously moving said two side plates of said support means comprises two threaded holes respectively solid with each of said two side plates; a screw mounted transversely on said rigid shell, movable by rotation about its axis and comprising two portions threaded in opposite directions each screwed in one of said two holes; and a control means accessible from the exterior of said rigid shell for turning said screw; and wherein a first one of said two portions threaded in opposite directions is movably mounted for translation movement with respect to the second one of said plates along the axis of said screw, said means for rapid tightening and loosening of said clamping means comprising a lever on the exterior of said boot for actuating said two threaded portions for translation movement with respect to one another.

11. A boot according to claim 1 to 10, wherein said clamping means is in lateral abutment against said shell.

12. A boot according to claim 11 wherein said means for simultaneously moving said two side plates of said support means comprises two threaded holes respectively solid with each of said two side plates; a screw mounted transversely on said rigid shell, movable by rotation about its axis and comprising two portions threaded in opposite directions each screwed in one of said two holes; and a control means accessible from the exterior of said rigid shell for turning said screw; and wherein said clamping means comprises a control means including a spherical member provided with a hollow driving block fitted on an end of said screw, and a gripping tongue mounted for pivoting movement about its brace, and acting as a stop means between said spherical member and said screw.

13. A boot according to claim 1, wherein said side plates are made of deformable resilient material.

14. A boot according to claim 13, wherein said side plates of deformable resilient material are provided on their upper portions with a compensating strip more rigid than said plates, for assuring both clamping and support of said plates along their entire length.

15. A boot according to claim 9, wherein said means for actuating said pressure elements from the exterior comprises two threaded holes respectively solid with each of said two pressure elements; a screw mounted on said rigid shell movable by rotation about its axis and comprising two portions threaded in opposite directions, each screwed in one fo said two holes; and a control means accessible from the exterior of said rigid shell for turning said screw; and wherein a first one of said two portions threaded in opposite directions is movably mounted for translation movement with respect to the second one of said plates along the axis of said screw, said means for rapid tightening and loosening of said clamping means comprising a lever on the exterior of said boot for actuating said two threaded portions for translation movement with respect to one another.

16. A boot according to claim 11, wherein said means for actuating said pressure elements from the exterior comprises two threaded holes respectively solid with each of said two pressure elements; a screw mounted on said rigid shell movable by rotation about its axis and comprising two portions threaded in opposite directions, each screwed in one of said two holes; and a control means accessible from the exterior of said rigid shell for turning said screw; and wherein said clamping means comprises a control means including a spherical member provided with a hollow driving block fitted on an end of said screw, and a gripping tongue mounted for pivoting movement about its brace, and acting as a stop means between said spherical member and said screw.

* * * * *